United States Patent [19]

Ishikawa

[11] Patent Number: 4,846,115

[45] Date of Patent: Jul. 11, 1989

[54] AIR-COOLED ENGINE

[75] Inventor: Tadashi Ishikawa, Urawa, Japan

[73] Assignee: Fuji Jukogyo Kabushiki Kaisha, Tokyo, Japan

[21] Appl. No.: 135,657

[22] Filed: Dec. 21, 1987

[30] Foreign Application Priority Data

Dec. 25, 1986 [JP] Japan ..... 61-201935[U]
Dec. 25, 1986 [JP] Japan ..... 61-201937[U]

[51] Int. Cl.[4] ..... F01P 1/02
[52] U.S. Cl. ..... 123/41.7
[58] Field of Search ..... 123/41.6, 41.62, 41.7, 123/198 E, 192 B

[56] References Cited

U.S. PATENT DOCUMENTS 3,744,468 7/1973 Brann ..... 123/41.7 X
3,911,876 10/1975 Freyn ..... 123/41.7 X
4,126,115 11/1978 List et al. ..... 123/198 E
4,156,409 5/1979 Nakano ..... 123/192 B X
4,386,589 6/1983 Hatz et al. ..... 123/192 B
4,459,944 7/1984 Kirchweger et al. ..... 123/198 E X

FOREIGN PATENT DOCUMENTS 0035538 3/1979 Japan ..... 123/41.44
23456 7/1985 Japan .

*Primary Examiner*—Tony M. Argenbright
*Assistant Examiner*—Eric R. Carlberg
*Attorney, Agent, or Firm*—Martin A. Farber

[57] ABSTRACT

A fan cover is provided for including a fan of an engine. The fan cover has an outlet opening to a cylinder of the engine. A pair of baffles are provided on opposite sides of the cylinder in parallel with a crankshaft of the engine to define a space around the cylinder. One end of each of the baffles is secured to the outlet of the fan cover, and the other end is positioned to form an edge for an outlet of the space.

4 Claims, 7 Drawing Sheets

AIR-COOLED ENGINE

BACKGROUND OF THE INVENTION

The present invention relates to an air-cooled engine and more particularly to a compact air-cooled engine wherein effective cooling is performed.

In a conventional air-cooled engine, air introduced in a space surrounding cylinders by a fan with the aid of a baffle. However, the air is not sufficiently supplied to a space behind the cylinders which is located apart from an outlet of the fan, so that the engine is not effectively cooled.

Japanese Utility Model Publication No. 60-23456 discloses an engine where one end of a cylinder baffle and a muffler are securely mounted on a boss formed on a cylinder so as to lead the air to a back of the cylinder. The other end of the baffle is engaged with a pawl formed on a fan cover. However, air flow is obstructed by the boss, thereby preventing sufficient cooling of the cylinder.

SUMMARY OF THE INVENTION

The object of the present invention is to provide a compact air-cooled engine wherein air flow for cooling the engine smoothly flows around a cylinder and cylinder head so as to improve the cooling effect.

According to the present invention, there is provided an air-cooled engine having at least one cylinder and a fan, comprising a fan cover including the fan and having an outlet opening to the cylinder, a pair of baffles provided on opposite sides of the cylinder in parallel with a crankshaft of the engine to define a space around the cylinder, one end of each of the baffles being positioned adjacent the outlet of the fan cover, and the other end being positioned to form an edge for an outlet of the space. Also a belt cover is provided for covering a timing belt and pulleys for transmitting output of the crankshaft to a camshaft, and a part of the edge of the outlet of the space is formed by an edge of the belt cover. According to another feature of the invention the belt cover is located at a position laterally offset from a plane passing the axis of the crankshaft.

The other objects and features of this invention will become understood from the following description with reference to the accompanying drawings.

DETAILED DESCRIPTION OF THE PREFERRED EMBODIMENT

Figure 1:
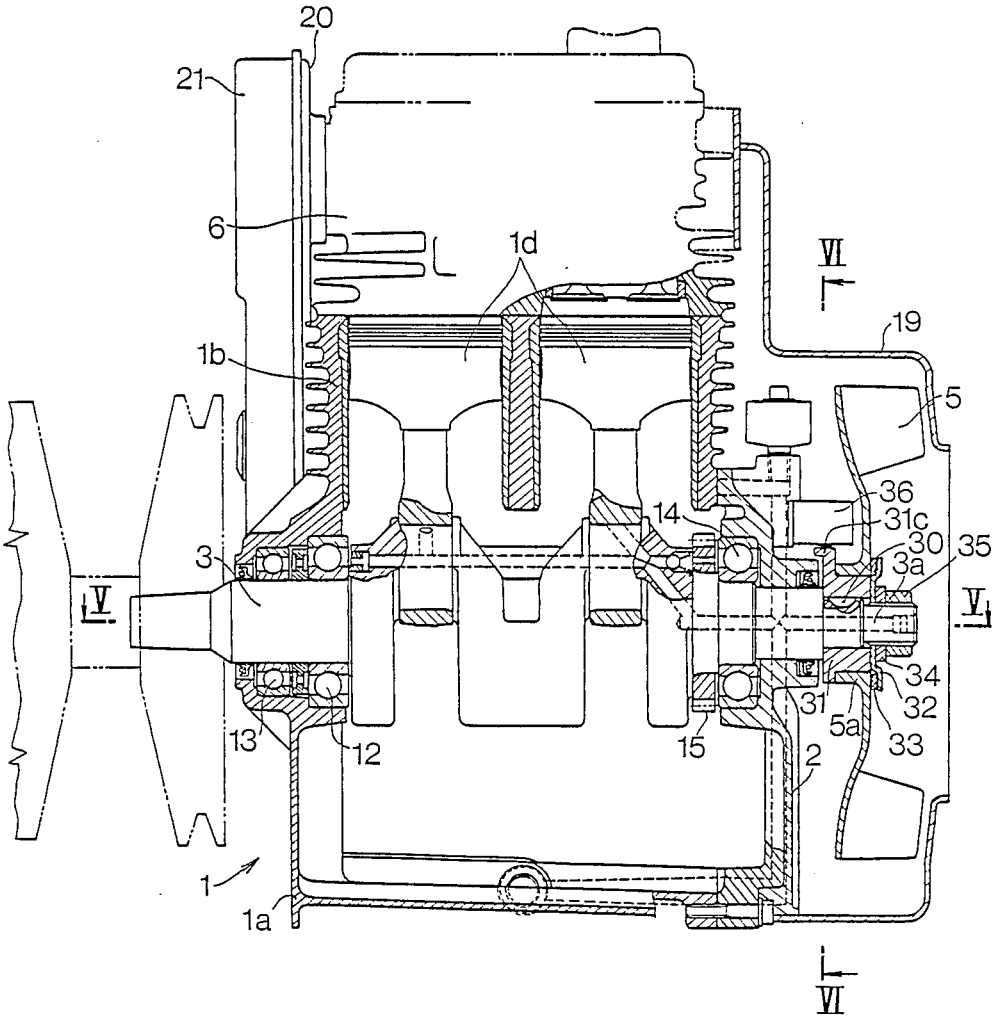
FIG. 1 is a sectional view of an air-cooled engine of the present invention.

Referring to FIG. 1, an air-cooled, two-cylinder engine of the present invention has a case body 1 comprising a crankcase 1*a* and a pair of cylinders 1*b* integral with the crankcase 1*a* each having a piston 1*d* therein, and a main bearing cover 2. A crankshahft 3 is supported by the crankcase 1*a* and the main bearing cover 2 through bearings 12, 13 and bearings 14, respectively. Secured to one end of the crankshaft 3 is a pulley for transmitting engine power and securely mounted on the other is a cooling fan 5 made of synthetic resin for producing air current.

Figure 2:
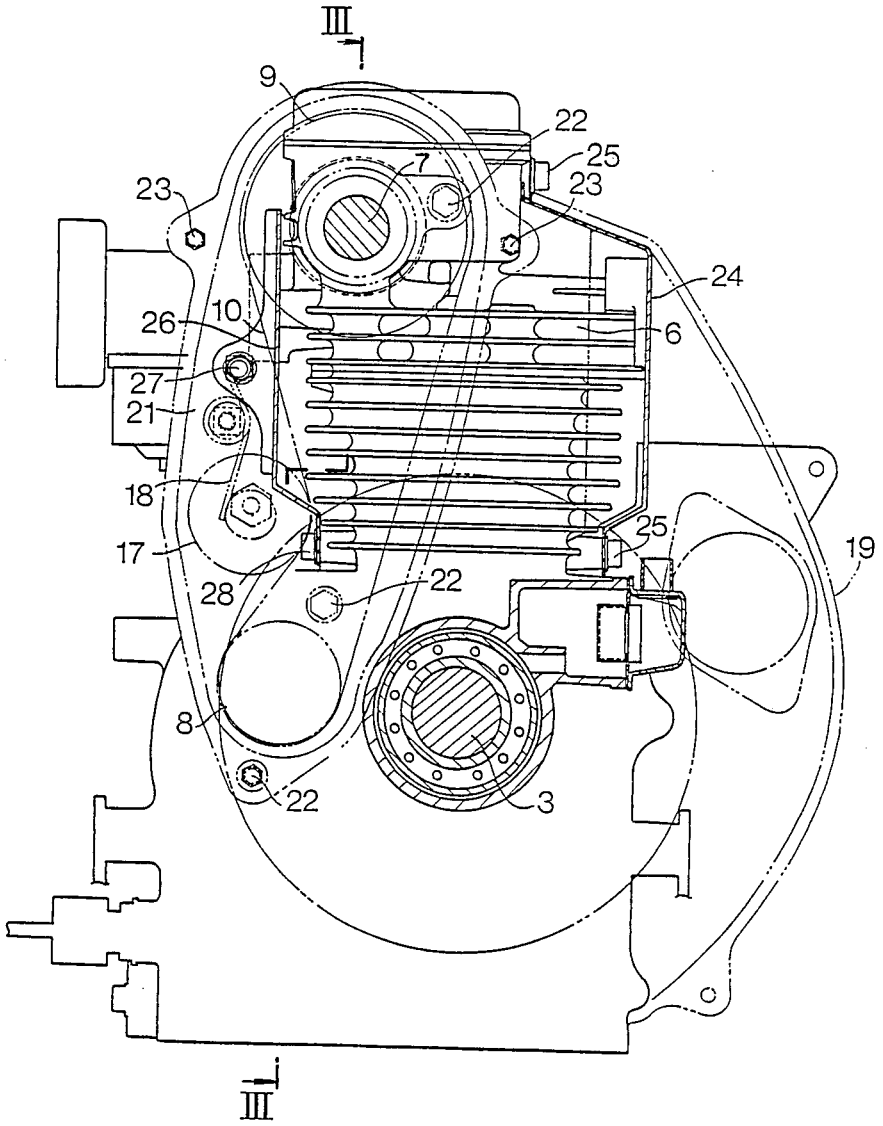
FIG. 2 is a side elevation as viewed from the left of the engine of FIG. 1.
Figure 3:
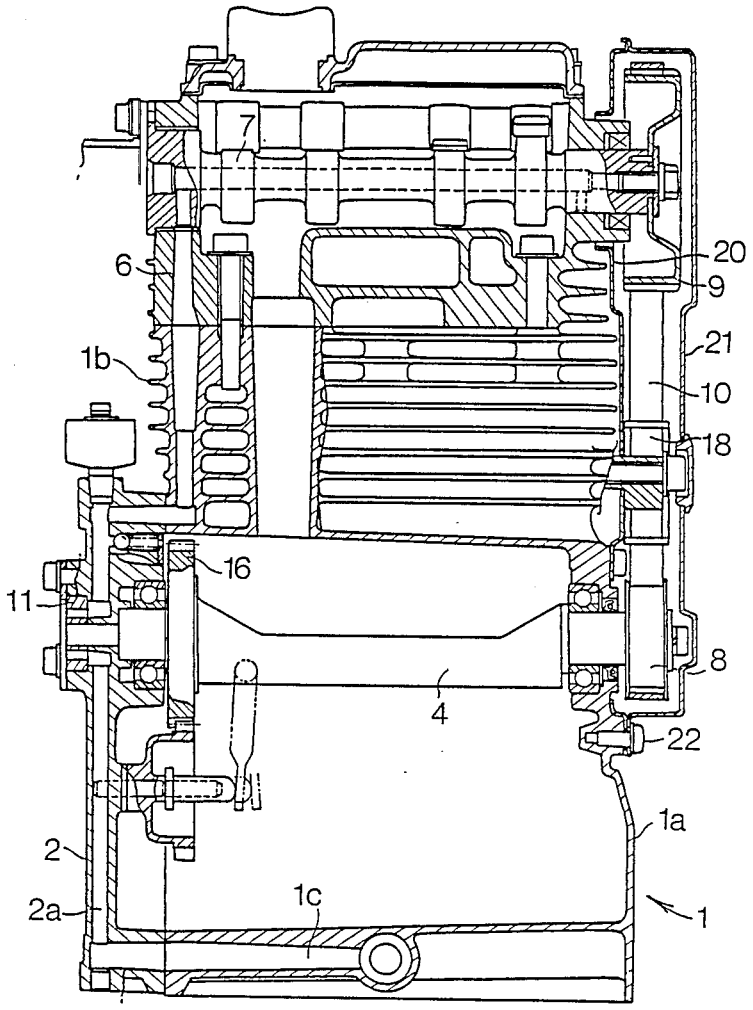
FIG. 3 is a sectional view taken along a line III—III of FIG. 2.
Figure 5:
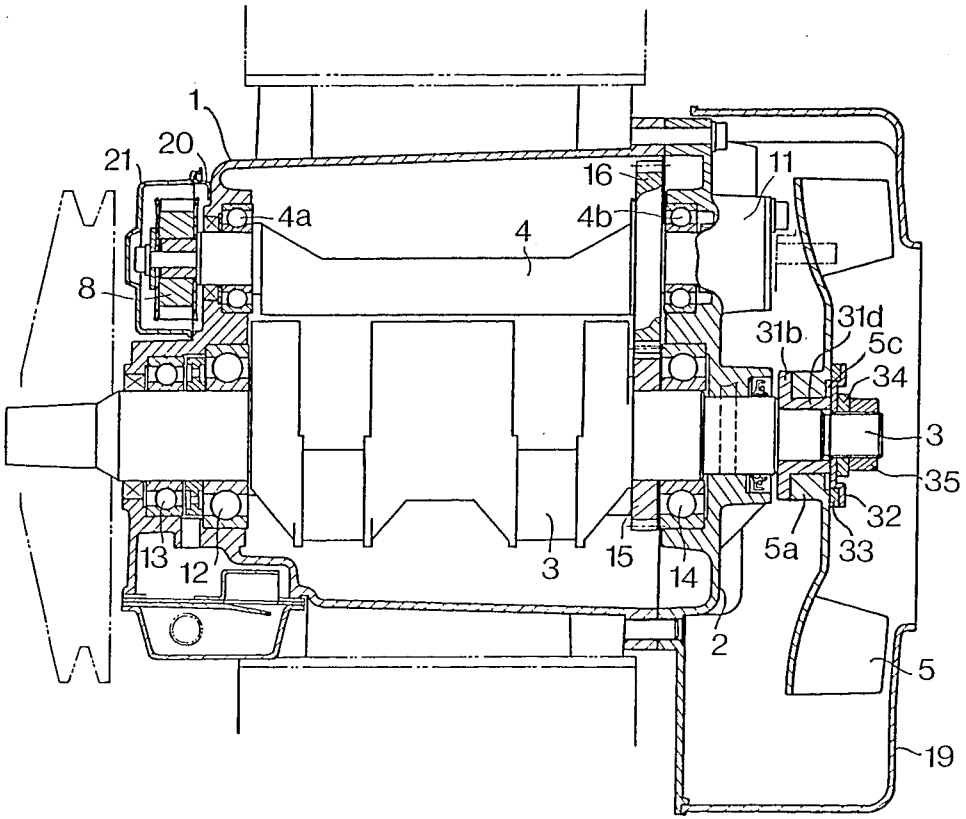
FIG. 5 is a sectional view taken along a line V—V of FIG. 1.

As shown in FIG. 5, a balancer shaft 4 is supported by bearings 4*a* and 4*b* provided in the crankcase 1*a* and the main bearing cover 2. A drive gear 15, which is securely mounted on the crankshaft 3 adjacent the main bearing cover 2, meshes with a driven gear 16 securely mounted on the balancer shaft 4 so as to rotate the balancer shaft 4. The balancer shaft 4 is connected to a camshaft 7 mounted in a cylinder head 6 through a drive pulley 8 disposed at the end of the balancer shaft 4 opposite from the gear 16, driven pulley 9 at an end of the camshaft 7, and a timing belt 10 running on the pulleys (FIG. 3). As shown in FIG. 2, an idler pulley 17 bears on the belt 10 so as to appropriately tense the timing belt by means of a spring 18. The pulleys 8, 9 and 17, timing belt 10 and spring 18 are covered by a belt cover 21 which is fixed to a cover base 20 by bolts 23. The base 20 is mounted on the cylinder head by bolts 22. Thus, the belt cover 21 is disposed at a position offset from a vertical plane passing through the axis of the crankshaft 3 in a lateral direction.

Figure 4:
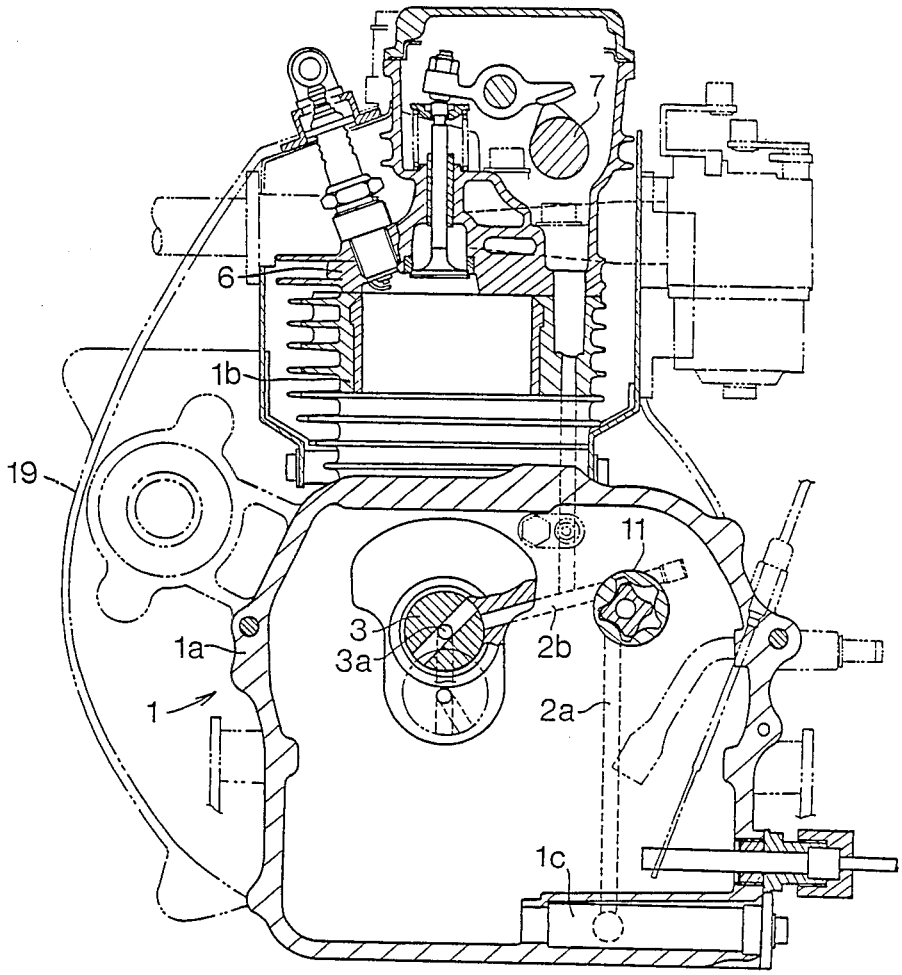
FIG. 4 is a sectional view showing a lubricating system in the engine of the present invention.

Referring to FIGS. 3 and 4, an oil pump 11 is mounted on the end of the balancer shaft 4 adjacent the gear 16. The pump 11 supplies lubricating oil from an oil reservoir 1*c* formed in a bottom portion of the case body 1 through an oil passage 2*a* formed in the main bearing cover 2, to an oil pasage 3*a* in the crankshaft 3 through an oil passage 2*b* formed in the main bearing cover 2, as shown in FIG. 4.

Figure 6:
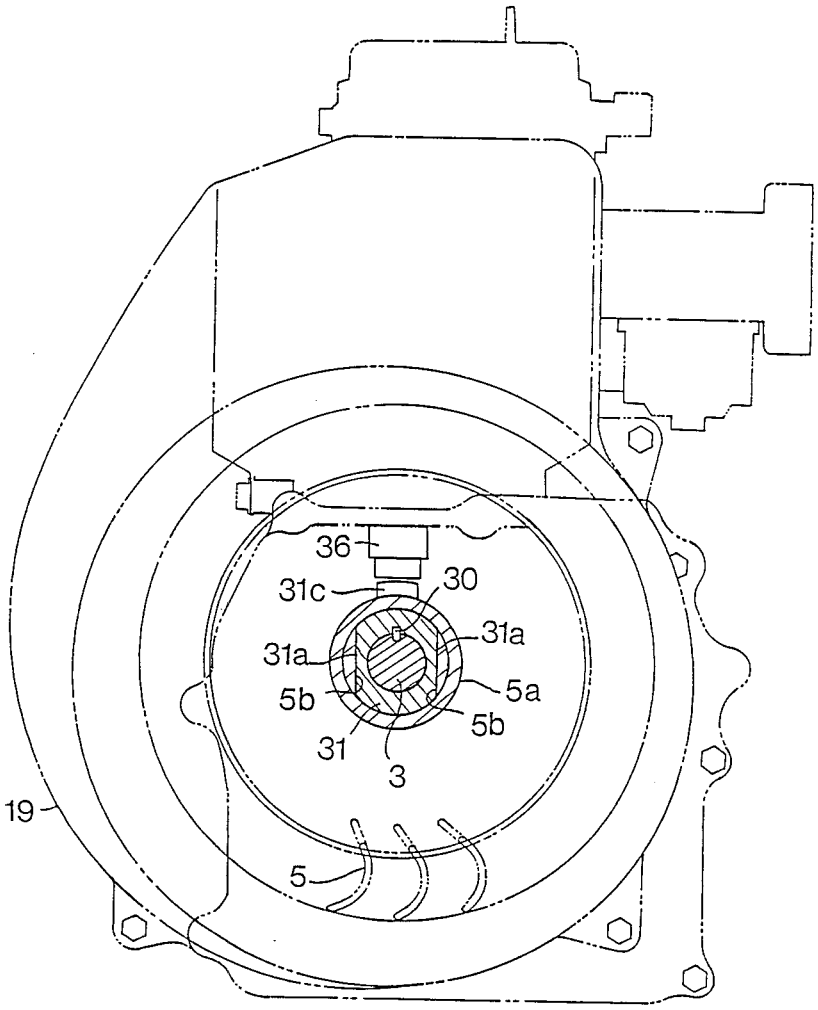
FIG. 6 is a sectional view taken along a line VI—VI of FIG. 1.

A mounting structure of the afore-mentioned cooling fan 5 is described hereinafter with reference to FIGS. 1, 5 and 6. A flanged metal rotor 31 comprising a flange 31*b* and a cylindrical portion 31*d* is fixedly mounted on a crankshaft 3 interposing a woodruff key 30. A periphery of the cylindrical portion 31*d* is cut away so as to form a pair of parallel faces 31a. The fan 5 has a boss 5*a*, a bore of which has a pair of parallel faces 5*b* corresponding to the faces 31*a* of the rotor 31. The cylindrical portion 31*d* of the rotor 31 is embedded in the boss 5*a* so that the faces 31*a* and 5*b* abut against each other. The fan 5 is secured to the crankshaft 3 by a nut 35 interposing a washer 32 with a shoulder and a spring washer 34. An annular insulator 33, made of elastic material such as rubber, is interposed between the fan 5 and the washer 32. An annular recess 5*c* is formed at a center of the fan 5 on the opposite side of the boss 5*a* so that the fan 5 does not directly abut against the washer 32. Accordingly, the boss 5*a* is prevented from breaking when the nut is fastened too tightly, or the fan 5 is prevented from loosening during operation. A diameter of the shoulder of the washer 32 may be set smaller than the distance between the parallel faces 31*a* of the rotor 31 thereby omitting the recess 5*c*.

Figure 7:
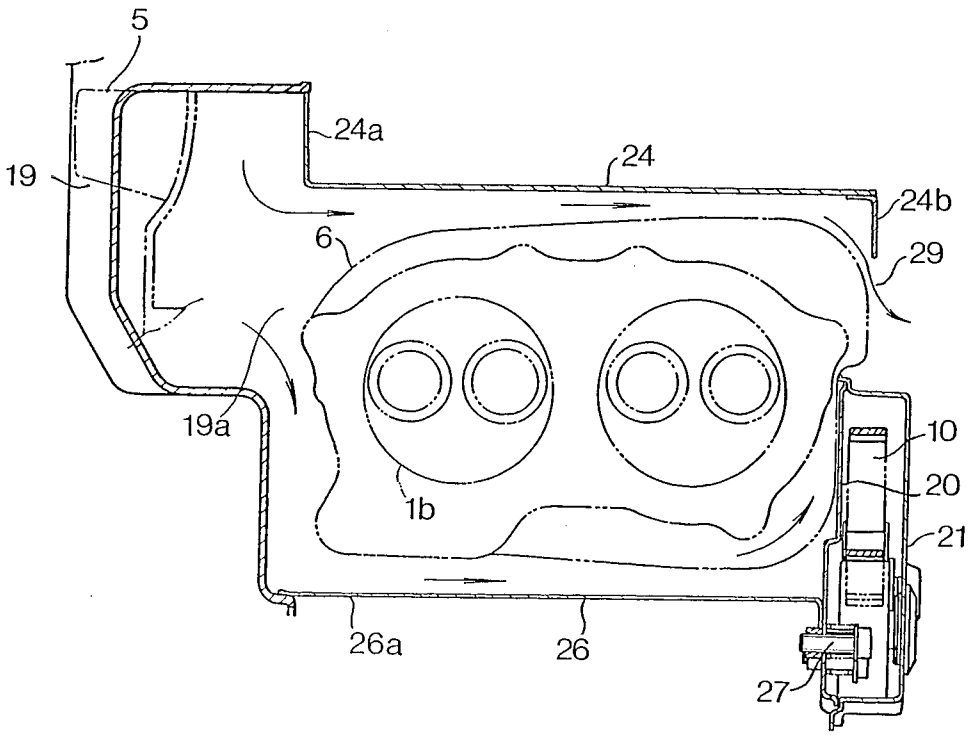
FIG. 7 is a sectional plan view of the engine.

On the flange 31*b* of the rotor 31, a projection 31*c* for producing ignition pulses is formed. When the projection 31*c* passes a coil 36 provided on the outer wall of the main bearing cover 2, an ignition pulse is produced. The fan 5 is covered by a fan cover 19. As shown in FIG. 7, the fan cover 19 has an outlet 19*a* opening to the cylinders 1*b*.

Referring to FIGS. 2 and 7, in order to guide the air flow produced by the fan 5, a pair of baffles 24 and 26 are provided on opposite sides of the cylinders 1*b* in parallel with the crankshaft 3 so as to surround the cylinders 1*b*. Both end portions of the baffle 24 are bent in lateral opposite directions as shown in FIG. 7. One end 24*a* is secured to an edge of the outlet 19*a* of the fan cover 19 and the other portion 24*b* is free. As shown in FIG. 2, the baffle 24 is fastened to the case body 1 at the upper and bottom portions by bolts 25.

The baffle 26 is provided at the other side of the cylinder head 6. One end 26*a* is supported by the fan cover 19 at the outlet thereof and the other is bent substantially at a right angle. The bent portion is secured to the cover base 20 by a bolt 27. The baffle 26 is also fastened to the case body 1 by bolts 28. The free end 24*b* of the baffle 24 and the opposing belt cover 21 define an outlet 29 through which the air is discharged. Thus, the air enters into the space defined by baffles 24 and 26 and cylinders 1*b* from the outlet of the cover 19, and flows out from the outlet 29 passing through the space, as shown by arrows in FIG. 7.

From the foregoing, it will be understood that the present invention provides a compact air-cooled engine wherein air flows smoothly without obstructions in air passages defined by cylinder baffles and the cylinders so as to efficiently cool the engine. Additionally, since the crankcase and the cylinders are integral and the belt cover serves as a part of a cylinder baffle, the number of the components for guiding the air flow is reduced and the construction is simplified.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. An air-cooled engine having at least one cylinder and a fan, comprising:

a fan cover including said fan and having an outlet opening to said cylinder;

a pair of baffles provided on opposite sides of said cylinder in parallel with a crankshaft of said engine to define a space around the cylinder;

one end of each of said baffles being positioned adjacent said outlet of said fan cover, and the other end being positioned to form an edge for an outlet of said space;

a belt cover covering a timing belt and pulleys for transmitting output of said crankshaft to a camshaft; and a part of the edge of said outlet of said space being formed by an edge of said belt cover.

2. The air-cooled engine according to claim 1 wherein said belt cover is located at a position laterally offset from a plane passing the axis of said crankshaft.

3. The air-cooled engine according to claim 1 wherein one of said pulleys is securely mounted on a shaft driven by said crankshaft through power transmitting means.

4. The air-cooled engine according to claim 3, wherein said shaft is a balancer shaft of said engine.

* * * * *